US009751677B2

(12) United States Patent
Fiere et al.

(10) Patent No.: US 9,751,677 B2
(45) Date of Patent: Sep. 5, 2017

(54) POUCH ASSEMBLY HAVING A PLUG

(71) Applicant: Scholle Corporation, Northlake, IL (US)

(72) Inventors: Jeroen Pieter Fiere, 's-Gravendeel (NL); Chad Mueller, Aurora, IL (US); Christopher Murray, Chicago, IL (US); David Bellmore, DeWitt, MI (US)

(73) Assignee: Scholle IPN Corporation, Northlake, IL (US)

( * ) Notice: Subject to any disclaimer, the term of this patent is extended or adjusted under 35 U.S.C. 154(b) by 86 days.

(21) Appl. No.: 14/860,689

(22) Filed: Sep. 21, 2015

(65) Prior Publication Data

US 2017/0081086 A1 Mar. 23, 2017

(51) Int. Cl.
*B65D 75/58* (2006.01)
*B65D 51/18* (2006.01)

(52) U.S. Cl.
CPC ..... *B65D 75/5883* (2013.01); *B65D 51/18* (2013.01); *B65D 2251/0015* (2013.01); *B65D 2251/0075* (2013.01)

(58) Field of Classification Search
CPC ..... B65D 39/08; B65D 39/12; B65D 41/06; B65D 41/04; B65D 43/021; B65D 43/0206; B65D 25/48; B65D 75/008; B65D 75/5883; B65D 75/5877; B65D 75/5872; B65D 75/5861; B65D 51/18
USPC ..... 215/358, 359, 360, 361, 356, 355, 364; 220/293, 288, 789, 787, 801, 802, 803, 220/804; 383/66, 42; 222/563, 544, 568, 222/567
See application file for complete search history.

(56) References Cited

U.S. PATENT DOCUMENTS 1,842,261 A * 1/1932 Garwood ..... B65D 39/12 215/354
1,904,091 A * 4/1933 Shoop ..... B65D 53/02 220/803
2,479,862 A * 8/1949 Payne ..... F16L 55/132 215/359

(Continued)

FOREIGN PATENT DOCUMENTS

EP 694477 A1 1/1996
GB 936781 A * 9/1963 ..... B65D 51/225

(Continued)

*Primary Examiner* — Robert J Hicks
(74) *Attorney, Agent, or Firm* — The Watson I.P. Group, PLC; Jovan N. Jovanovic; Vladan M. Vasiljevic

(57) ABSTRACT

A plug for a pouch assembly, where the plug includes a top wall, an inner axial skirt and an outer axial skirt. The inner axial skirt depends from the top wall in a direction opposite the top wall. The inner axial skirt includes an inner surface, an outer surface, an upper end and a lower end. The outer axial skirt includes an inner surface and an outer surface, an upper end proximate the top wall and a lower end spaced apart therefrom. A seal bead is positioned on the inner surface of the outer axial skirt spaced apart from the upper end. The seal bead extends inwardly toward the inner axial skirt. The plug is attachable to the spout of the pouch. The seal bead is structurally configured to hermetically seal against the spout, while precluding sealed engagement between the inner axial skirt and the spout.

21 Claims, 11 Drawing Sheets

(56) References Cited

U.S. PATENT DOCUMENTS

| | | | | | |
|---|---|---|---|---|---|
| 2,601,039 | A | * | 6/1952 | Livingstone | B65D 47/06 222/109 |
| 2,689,665 | A | * | 9/1954 | Martin | B65D 41/0492 215/334 |
| 3,124,281 | A | * | 3/1964 | Stull | B65D 47/141 222/542 |
| 3,499,568 | A | | 3/1970 | Vinas Riera | |
| 4,394,923 | A | | 7/1983 | Sugiyama | |
| 4,458,734 | A | | 7/1984 | Scholle et al. | |
| 5,299,702 | A | * | 4/1994 | Kneer | B65D 39/16 215/256 |

FOREIGN PATENT DOCUMENTS

| | | | |
|---|---|---|---|
| JP | 2002-321715 | A | 11/2002 |
| JP | 2003-072717 | A | 3/2003 |
| JP | 2003-237742 | A | 8/2003 |
| JP | 2006-206159 | A | 8/2006 |
| JP | 2007197030 | A | 8/2007 |
| JP | 2007204063 | A | 8/2007 |
| JP | 2013071781 | A | 4/2013 |
| JP | 2016-8055 | A | 1/2016 |
| WO | 2012055459 | A1 | 5/2012 |
| WO | 2016189754 | A1 | 12/2016 |

* cited by examiner

POUCH ASSEMBLY HAVING A PLUG

CROSS-REFERENCE TO RELATED APPLICATION

N/A

BACKGROUND OF THE DISCLOSURE

1. Field of the Disclosure

The disclosure relates in general to a pouch for flowable material, and more particularly, a pouch assembly having a plug.

2. Background Art

The filling of flexible packaging and pouches is known in the art. Generally, such filling occurs in an environment wherein the package is handled, opened, filled and then recapped. As requirements have become more stringent, the prospect of aseptic filling of flowable material, namely foodstuffs, has become significantly more important.

Aseptic filling is the filling of a product, for example, a foodstuff, in a sterile container. With the product being sterile as well, the foodstuff can keep for extended periods of time without the use of preservatives. Typically, such products are contained in flexible bags (as part of bag in box packaging) or in rigid packaging containers such as blown polymer bottles, or cartons made from paperboard laminations.

Problematically, it has been difficult to utilize standup pouches with fitments in the aseptic filling process. In particular, pouches tend to be difficult to sterilize and it has been costly to apply threaded closures to such packaging. Indeed, a cost effective solution for aseptic filling of standup pouches having fitments has been a challenge. It has been challenging to provide a standup pouch assembly that includes a fitment for aseptic filling that has versatility and that can be well suited to modification.

SUMMARY OF THE DISCLOSURE

The disclosure is directed to a plug for a pouch assembly. The plug is attachable to a spout of a pouch. The spout provides access to a cavity defined by the pouch. The plug comprises a top wall, an inner axial skirt, and an outer axial skirt. The top wall includes an outer surface and an outer rim. The inner axial skirt depends from the top wall in a direction opposite the top wall. The inner axial skirt includes an inner surface, an outer surface, an upper end and a lower end. The inner surface defines an inner cavity. The outer axial skirt is axially spaced apart from the inner axial skirt. The outer axial skirt includes an inner surface and an outer surface, an upper end proximate the top wall and a lower end spaced apart therefrom. A seal bead is positioned on the inner surface of the outer axial skirt spaced apart from the upper end. The seal bead extends inwardly toward the inner axial skirt. The plug is attachable to the spout of the pouch. The seal bead is structurally configured to hermetically seal against the spout, while the inner axial skirt extends into the spout without sealingly engaging the same to provide a seal between the inner axial skirt and the spout.

In some configurations, the inner surface of the inner axial skirt defines a cavity structurally configured to receive a post or other component of a filler.

In some configurations, the inner axial skirt and the outer axial skirt are substantially concentric cylindrical members.

In some configurations, the inner axial skirt further includes a plurality of spacing ribs extending outward from the outer surface of the inner axial skirt. The plurality of spacing ribs are structurally configured to extend to the spout of the pouch, to, in turn, provide passageways between the axial ribs, so as to maintain fluid communication between the seal bead and the cavity.

In some configurations, the plurality of spacing ribs comprises eight ribs substantially equally spaced about the outer surface of the inner axial skirt.

In some configurations, an annular channel is disposed below the top wall.

In some configurations, the annular channel includes an upper wall and a lower wall. The upper and lower walls are spaced apart from each other, with an inner wall spanning therebetween.

In some configurations, the annular channel defines a plane that is substantially perpendicular to the inner axial skirt and the outer axial skirt.

In some configurations, the annular channel is disposed between the top surface and the channel defined by the inner and outer axial skirts.

In some configurations, the outer rim of the top wall is one of chamfered, inclined and rounded toward, and meets the upper wall of the annular channel.

In some configurations, the top surface includes a concave surface portion that is inwardly spaced from the outer rim.

In some configurations, the top surface further includes a substantially planar outer ring surface between the outer rim and the concave surface portion.

In some configurations, the inner axial skirt extends beyond the hermetic seal bead positioned on the inner surface of the outer axial skirt.

In another aspect of the disclosure, the disclosure is directed to a pouch assembly comprising a pouch, a spout and a cap. The pouch defines a cavity. The spout includes an attachment flange, an outlet tube and a thread. The attachment flange is sealingly engaged to a pouch body, providing access to a cavity defined thereby. The outlet tube has a first end cooperating with the cavity, and a second end spaced apart therefrom, and an outer surface, with a plug locking surface defined in the outer surface. The thread extends about the outer surface of the outlet tube.

The plug includes a top wall, an inner axial skirt and an outer axial skirt. The top wall has an outer rim. The inner axial skirt depends from the top wall in a direction opposite the top wall. The inner axial skirt includes an inner surface, an outer surface, an upper end and a lower end. The inner surface defines an inner cavity. The outer axial skirt is axially spaced apart from the inner axial skirt. The outer axial skirt includes an inner surface and an outer surface, an upper end proximate the top wall and a lower end spaced apart therefrom. A seal bead is positioned on the inner surface of the outer axial skirt spaced apart from the upper end. The seal bead extends inwardly toward the inner axial skirt.

The inner axial skirt is releasably extendable into the outlet tube with the hermetic seal bead forming a hermetic seal against the plug locking surface of the outlet tube. A portion of the inner axial skirt is spaced apart from the outlet tube so that a seal is not formed therebetween.

In some configurations, the inner axial skirt further includes at least one rib extending outwardly from the outer surface of the inner axial skirt. The at least one rib maintains separation of the outer surface of the inner axial skirt and the inner surface of the outlet tube of the spout.

In some configurations, the plug further includes an annular channel disposed below the top wall. The annular channel includes an upper wall that meets the outer rim of the top wall.

In some configurations, the annular channel defines a plane substantially perpendicular to each of the inner axial skirt and the outer axial skirt.

In some configurations, the annular channel further includes a lower wall that is substantially parallel to the upper wall and spaced apart therefrom by an inner wall.

In some configurations, the inner skirt extends beyond the hermetic seal bead of the outer axial skirt.

In some configurations, the pouch assembly further comprises a cap. The cap includes a central body configured to extend over the outlet tube of the spout. The central body has a transverse ledge. The transverse ledge extends into the annular channel of the plug, to, in turn, axially couple the plug to the cap. Removal of the cap from the pouch removes the plug together with the cap.

In some configurations, the central body of the cap includes a plurality of threads that, upon engagement of the cap and the spout, threadedly engage the threads of the spout.

BRIEF DESCRIPTION OF THE DRAWINGS

The disclosure will now be described with reference to the drawings wherein.

DETAILED DESCRIPTION OF THE DISCLOSURE

Figure 1:
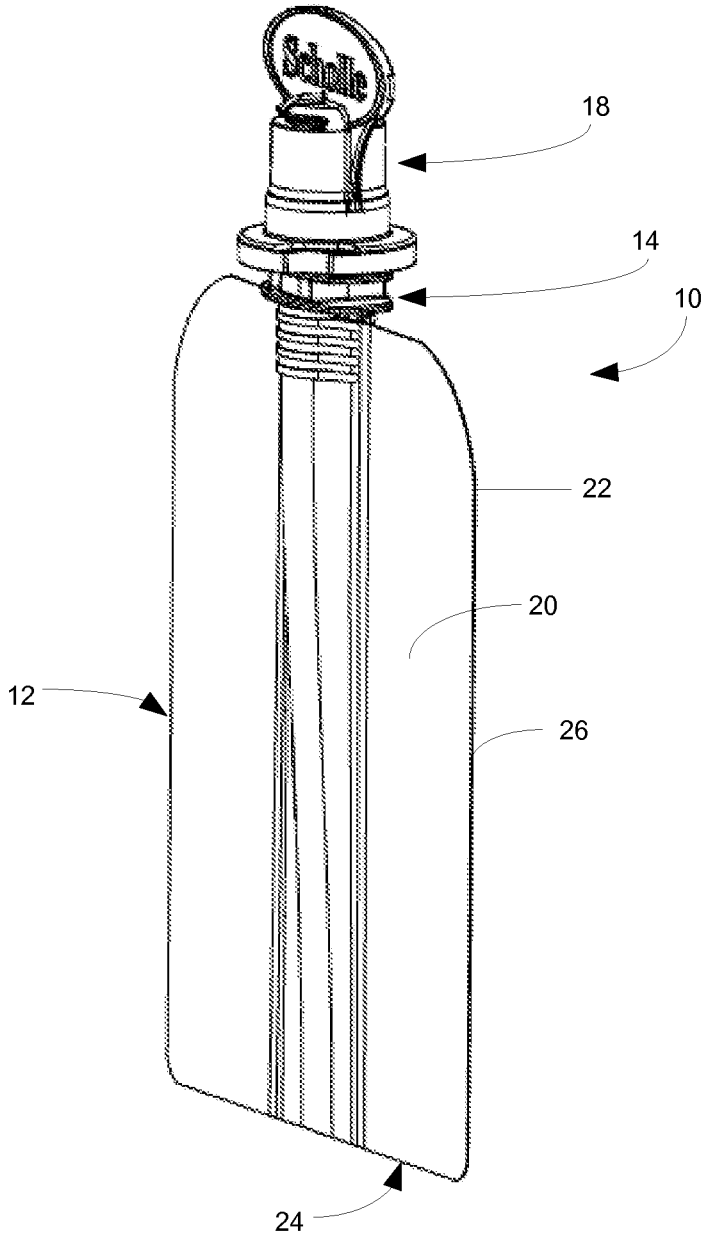
FIG. 1 of the drawings is a perspective view of the pouch assembly of the present disclosure.
Figure 2:
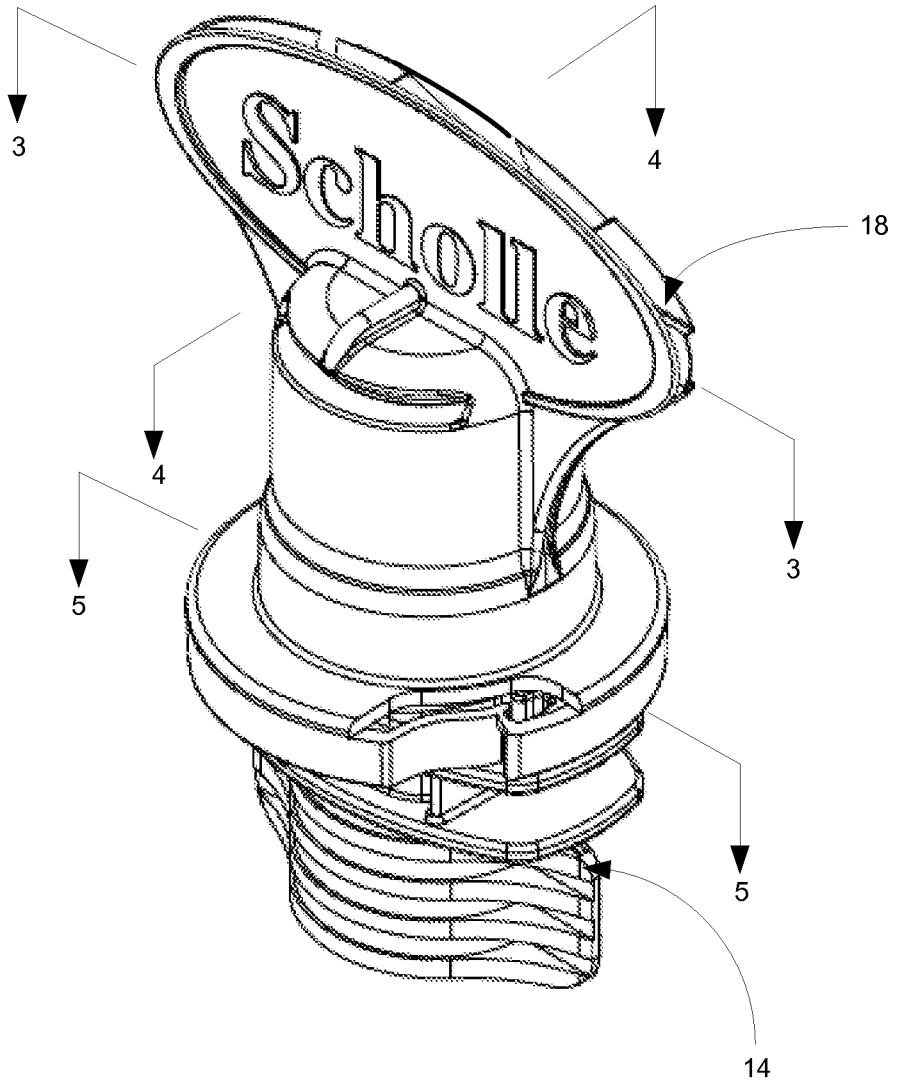
FIG. 2 of the drawings is a perspective view of the spout and cap of the pouch assembly of the present disclosure.
Figure 4:
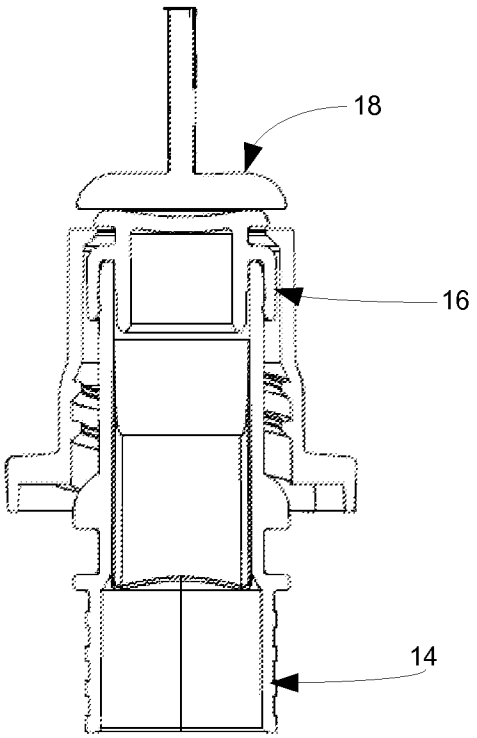
FIG. 4 of the drawings is a cross-sectional view of the spout, plug and cap of the pouch assembly of the present disclosure, taken generally about lines 4-4 of FIG. 2.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the pouch assembly having a plug is shown generally at 10. Such a pouch is configured for filling, preferably, in an aseptic pouch filling assembly. Such filling assemblies are configured to fill of pouches in an aseptic environment and within an aseptic zone. It will be understood that an aseptic zone comprises a zone that is under a positive flow of sterilized gas (typically sterilized air), and that has been cleaned to aseptic standards standards such as those disclosed in Title 21 of the Code of Federal Regulations pertaining to thermally processed low acid foods packaged in hermetically sealed containers overseen by the U.S. FDA, as well as 3-A Sanitary Standards, Inc. and European Hygienic Engineering and Design Group (EHEDG) Standards.

Figure 3:
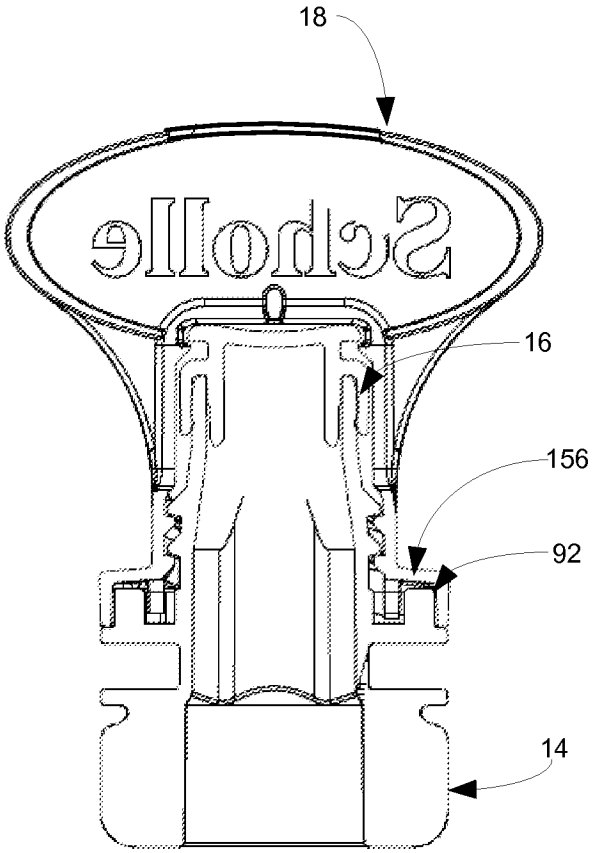
FIG. 3 of the drawings is a cross-sectional view of the spout, plug and cap of the pouch assembly of the present disclosure, taken generally about lines 3-3 of FIG. 2.

The pouch assembly is shown in greater detail in FIG. 1 as comprising body 12, spout 14, plug 16 (FIG. 3) and cap 18. The body 12 includes first side panel 20, second side panel 22, lower gusset structure 24. The first side panel, the second side panel and the lower gusset structure are coupled together through seals 26 to form cavity 27 configured to retain a flowable material, such as a foodstuff or the like. In many configurations, the gusset structure 24 provides a base surface from which the pouch can be in a standup configuration. Of course, in other configurations, the pouch can be formed from a plurality of panels greater than two panels or from a single panel along with a plurality of folds, wherein the panels cooperate to form the gusset at the lower end thereof. Furthermore, additional structures or gussets (such as side gussets) or gussetless constructions are likewise contemplated). Typically, the cavity is on the order of 60 ml to 500 ml in size. More preferably, the cavity is on the order of 60 ml and 180 ml in size, and more preferably, the cavity is on the order of 90 ml to 120 ml. Of course, variations are contemplated, and the foregoing cavity volumes are exemplary only, and not considered to be limiting. Prior to introduction into the cartridge filling assembly, the pouches have been sterilized through gamma sterilization or the like. As such, the cavities are free of pathogens, and are a sterile environment. The plug has a hermetic seal thereby precluding the passage of material into (or out of) the spout. Generally, such pouches are formed from a multi-layer polymer structures that may include metal or metallized layers, and which may be co-extruded and/or laminated. As will be understood, the pouch (in a capped configuration) is pre-sterilized prior to introduction into filler equipment through, for example, gamma, x-ray, e-beam or other sterilization process, such that the internal cavity of the pouch is free of pathogens and a sterile environment.

Figure 5:
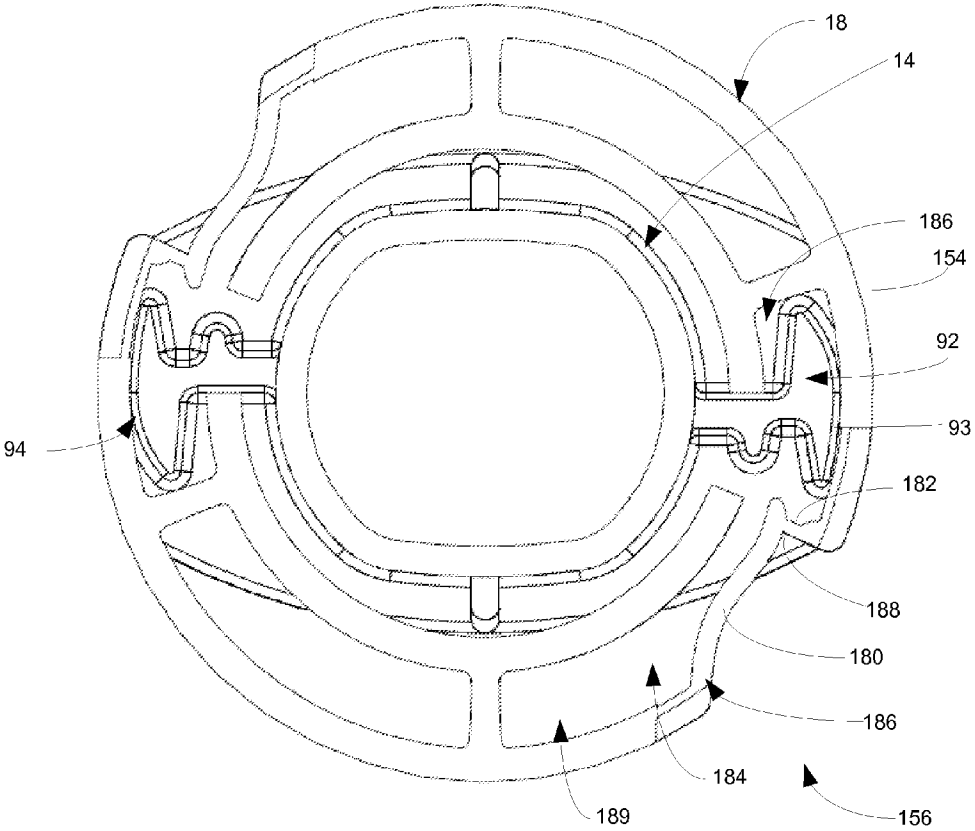
FIG. 5 of the drawings is a cross-sectional view of the spout and cap of the pouch assembly of the present disclosure, taken generally about lines 5-5 of FIG. 2.
Figure 6:
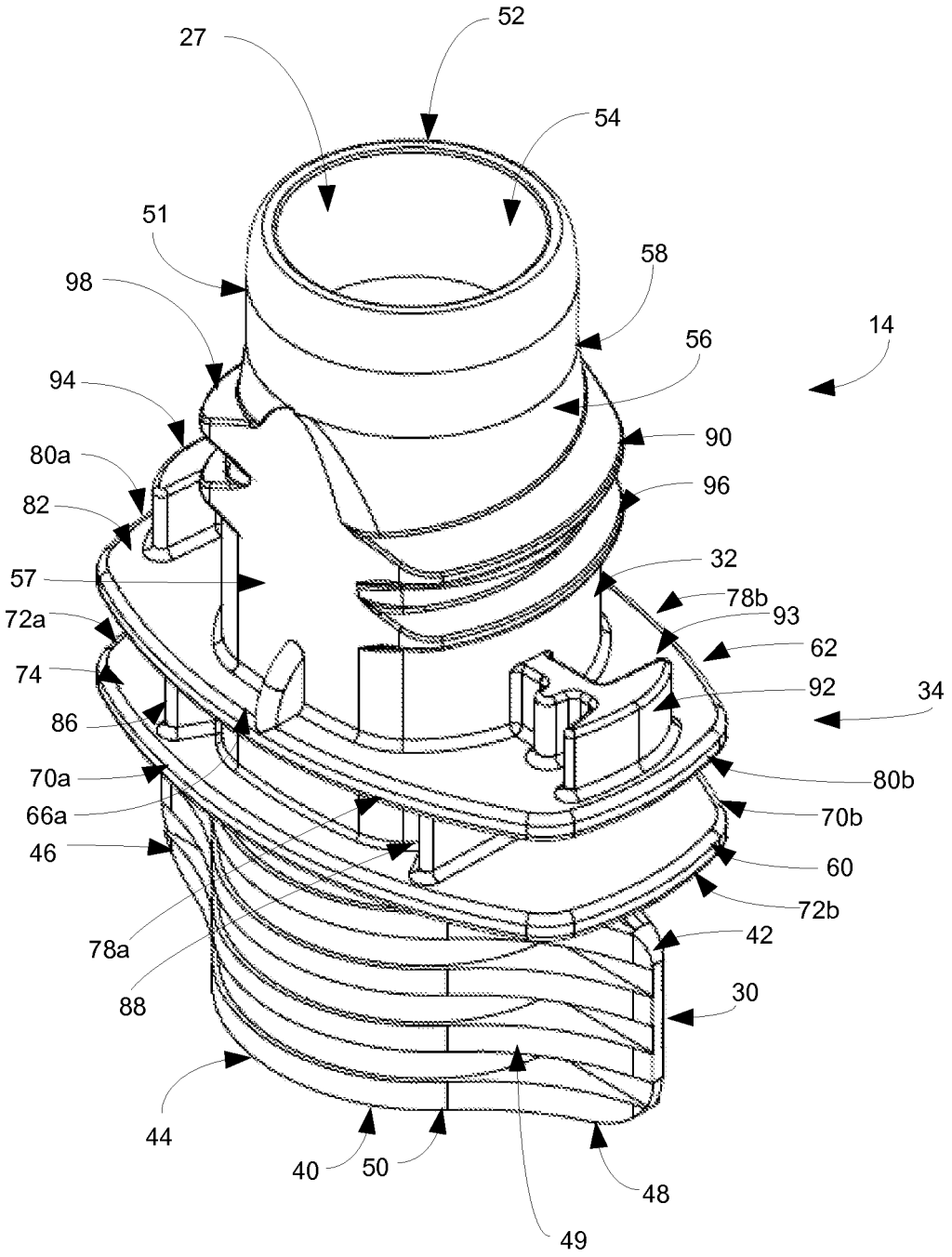
FIG. 6 of the drawings is a perspective view of the spout of the pouch assembly of the present disclosure.
Figure 7:
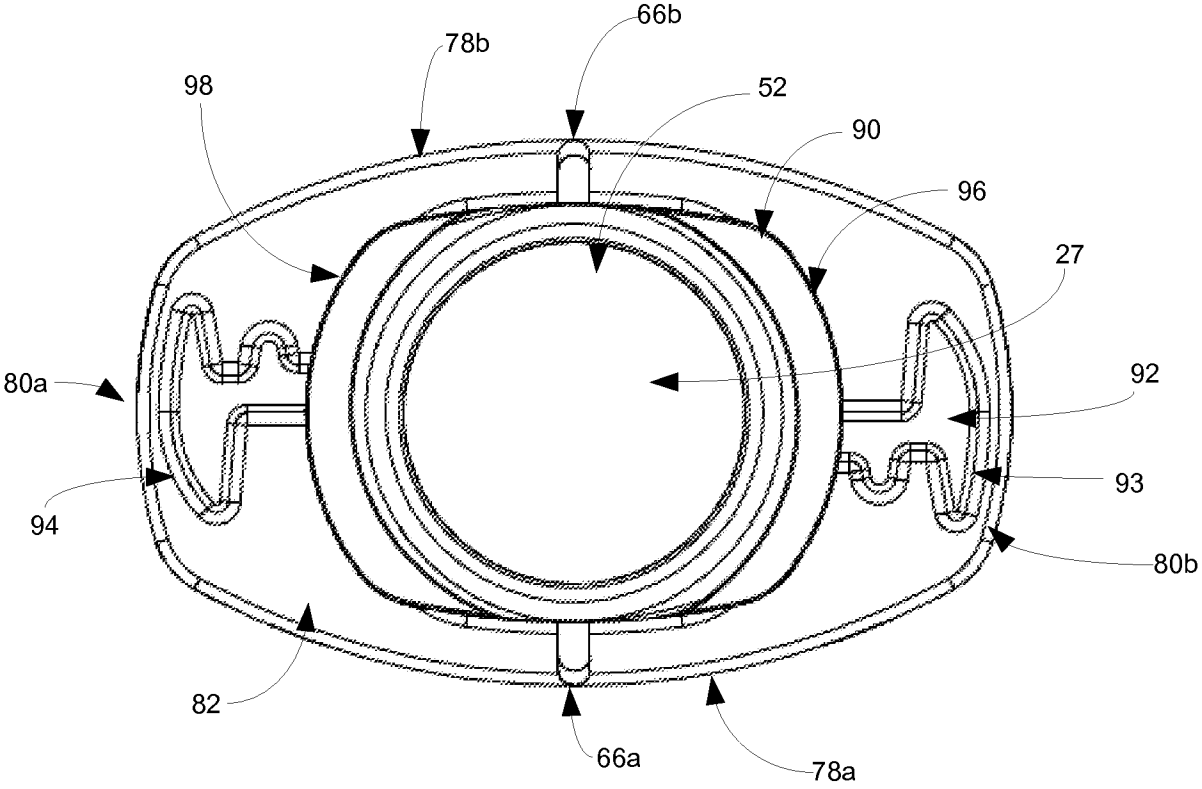
FIG. 7 of the drawings is a top plan view of the spout of the pouch assembly of the present disclosure.
Figure 8:
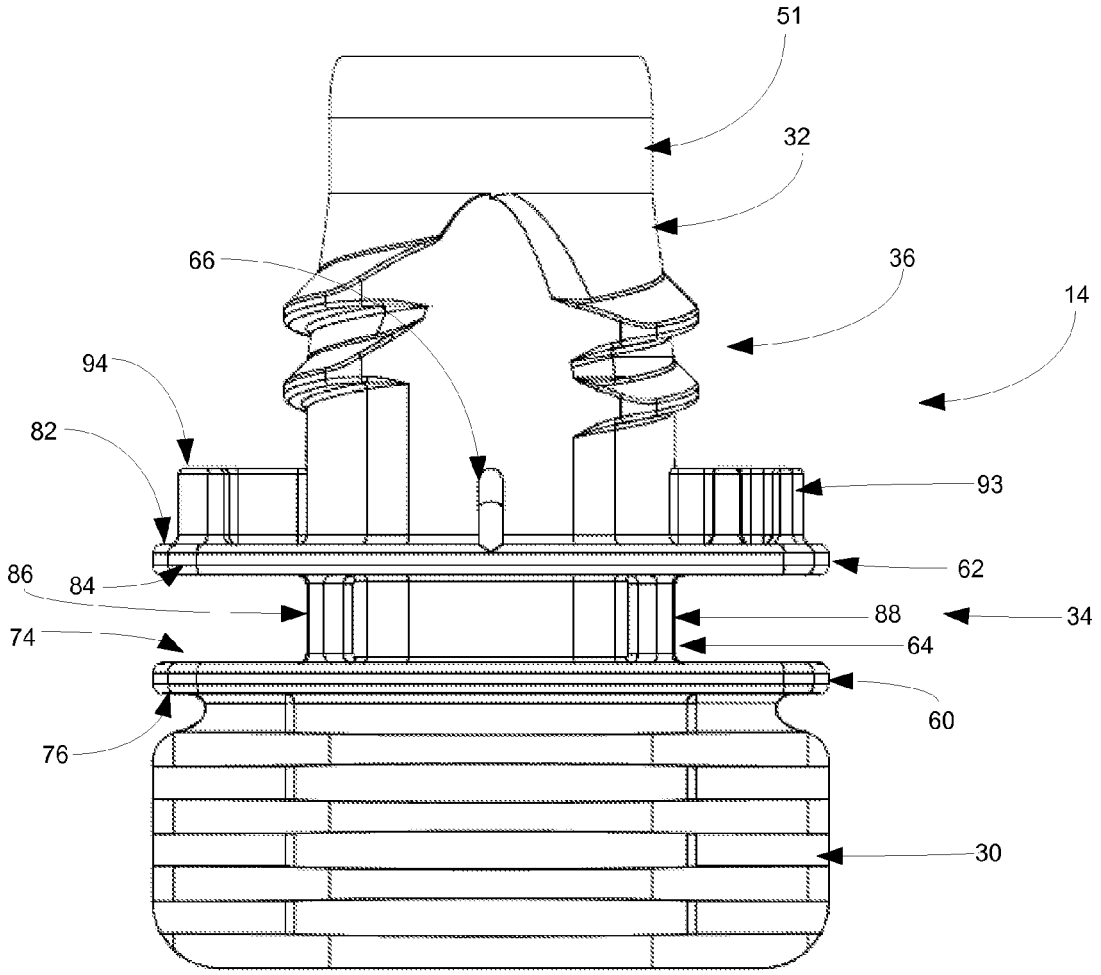
FIG. 8 of the drawings is a side elevational view of the spout of the pouch assembly of the present disclosure.
Figure 12:
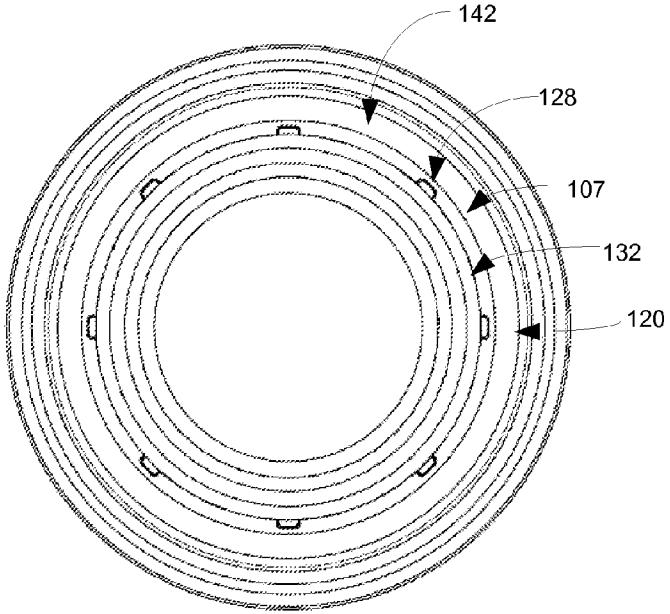
FIG. 12 of the drawings is a bottom plan view of the plug of the pouch assembly of the present disclosure.
Figure 9:
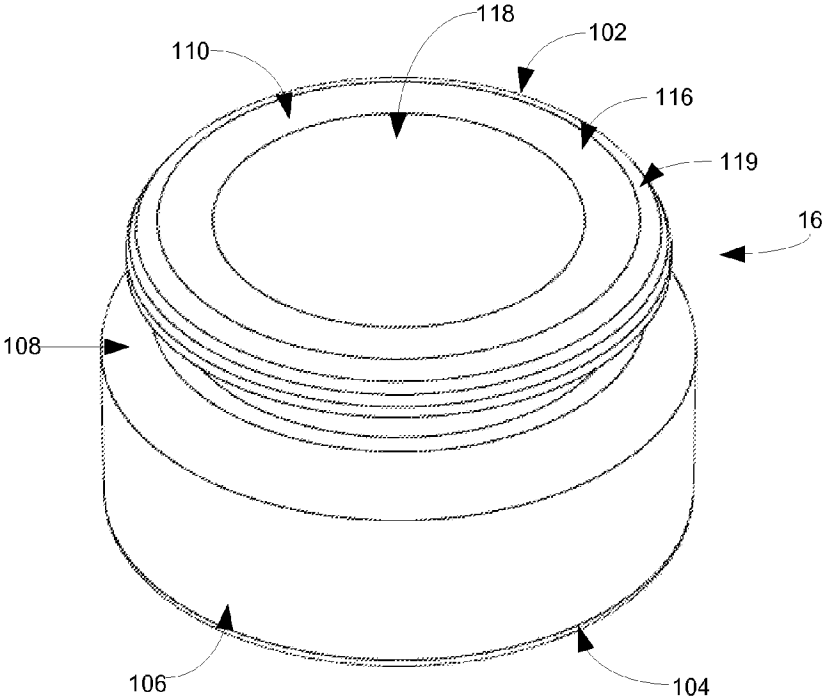
FIG. 9 of the drawings is a perspective view of the plug of the pouch assembly of the present disclosure.
Figure 10:
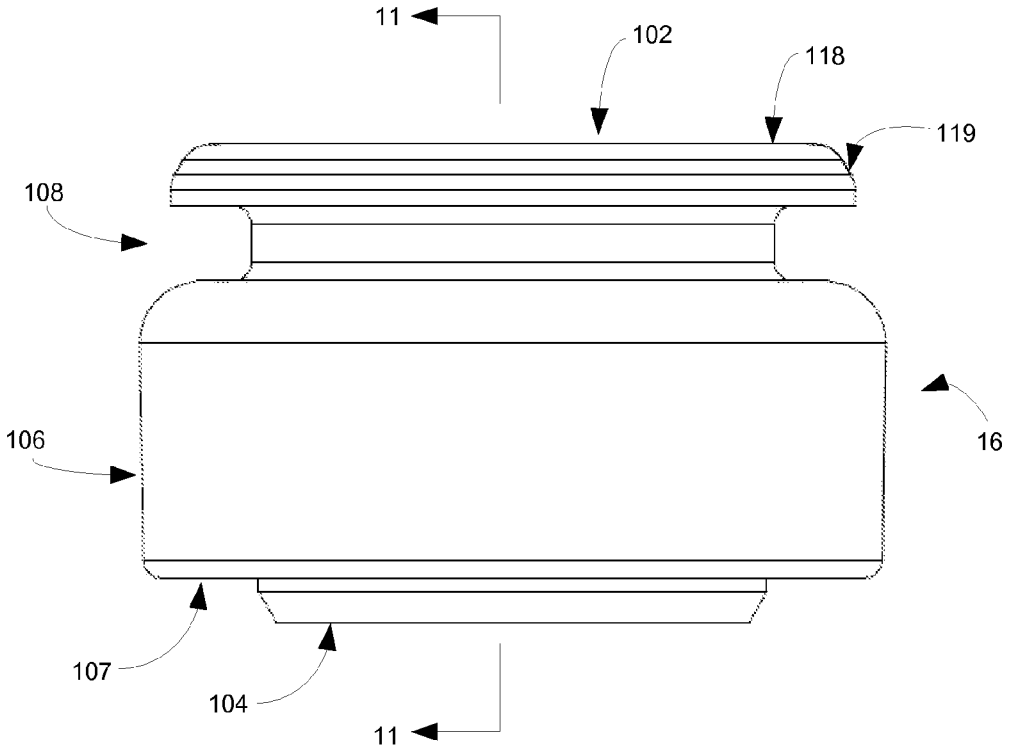
FIG. 10 of the drawings is a side elevational view of the plug of the pouch assembly of the present disclosure.
Figure 11:
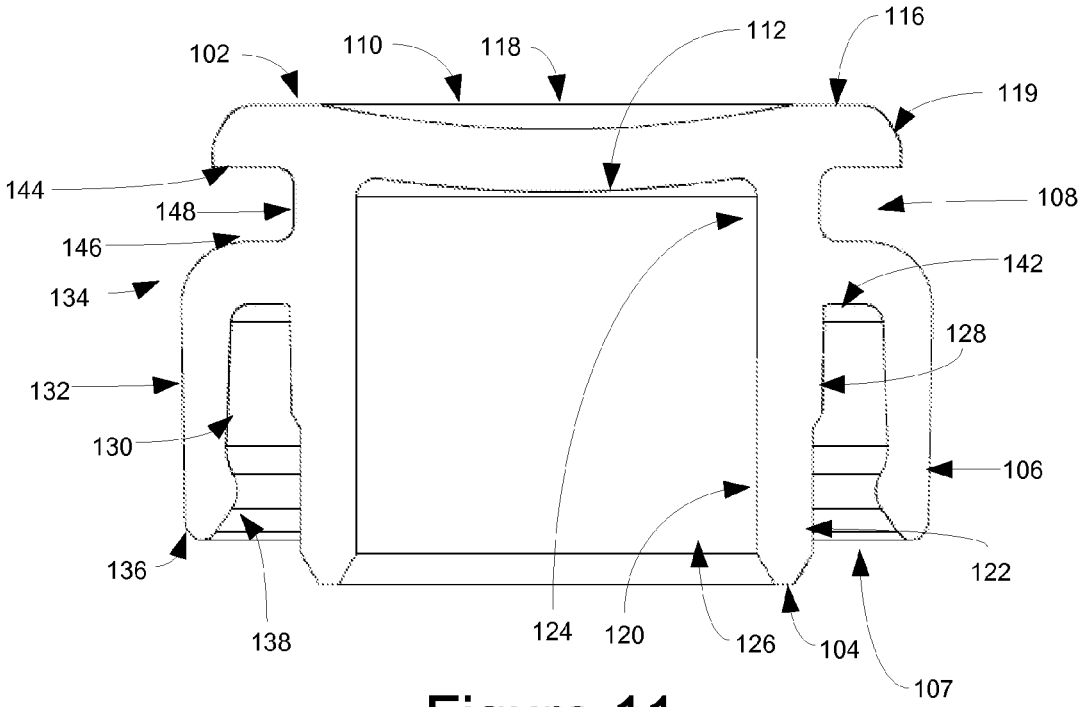
FIG. 11 of the drawings is a cross-sectional view of the plug of the pouch assembly of the present disclosure, taken generally about lines 11 of FIG. 10.
Figure 13:
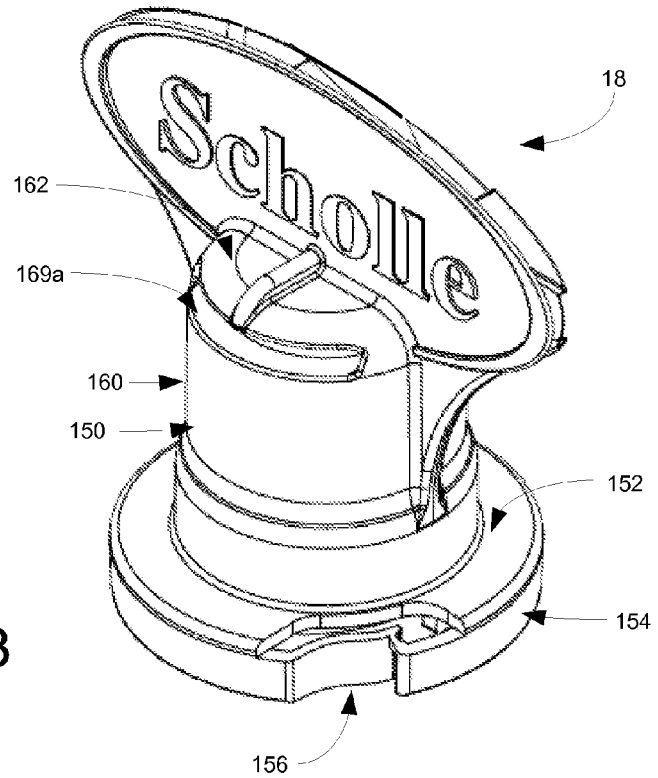
FIG. 13 of the drawings is a perspective view of the cap of the pouch assembly of the present disclosure.
Figure 14:
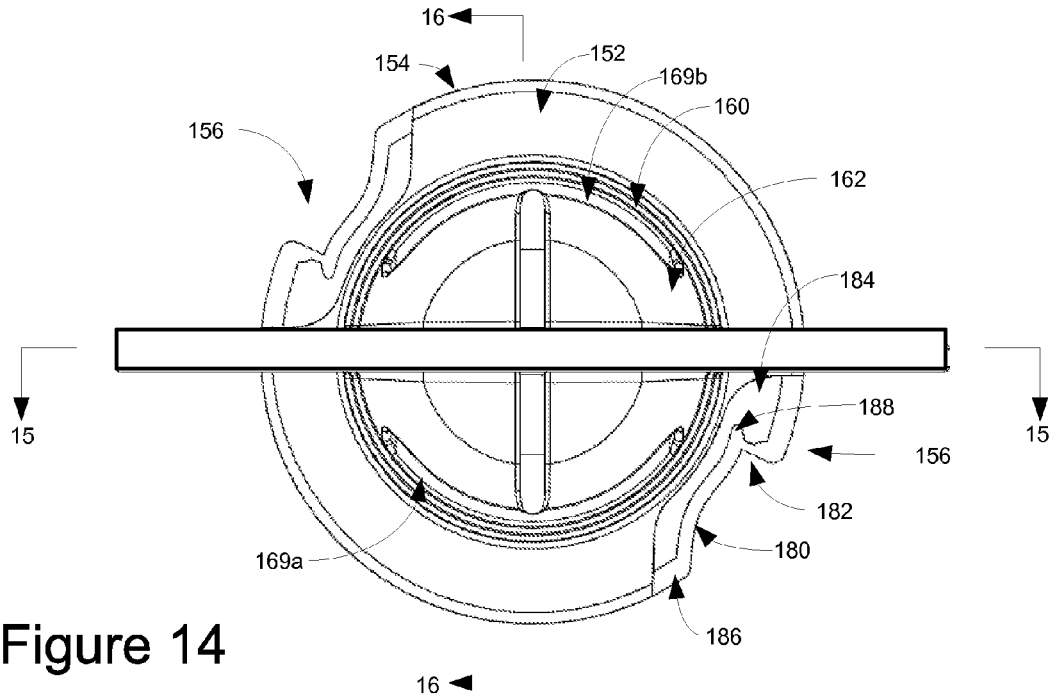
FIG. 14 of the drawings is a top plan view of the cap of the pouch assembly of the present disclosure.
Figure 16:
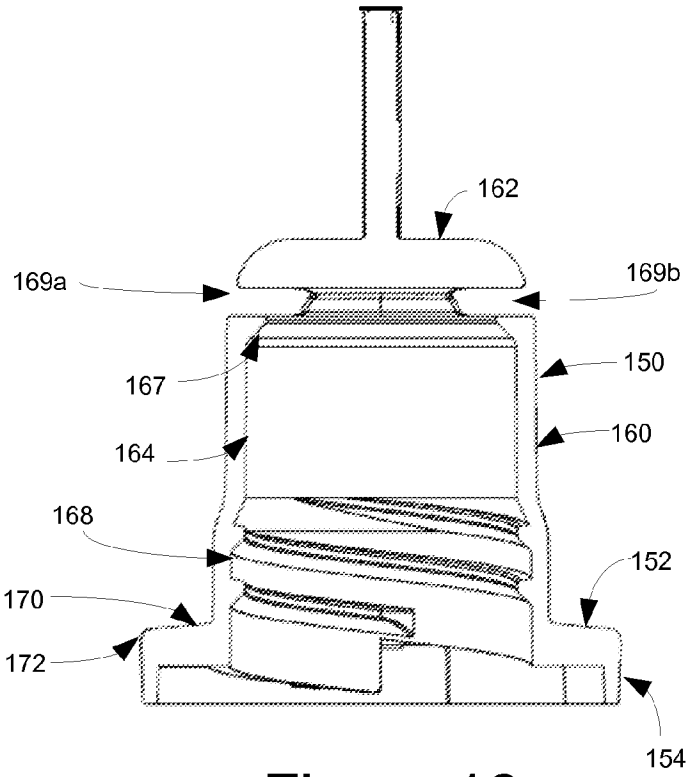
FIG. 16 of the drawings is a cross-sectional view of the cap of the pouch assembly of the present disclosure, taken generally about lines 16-16 of FIG. 14.
Figure 15:
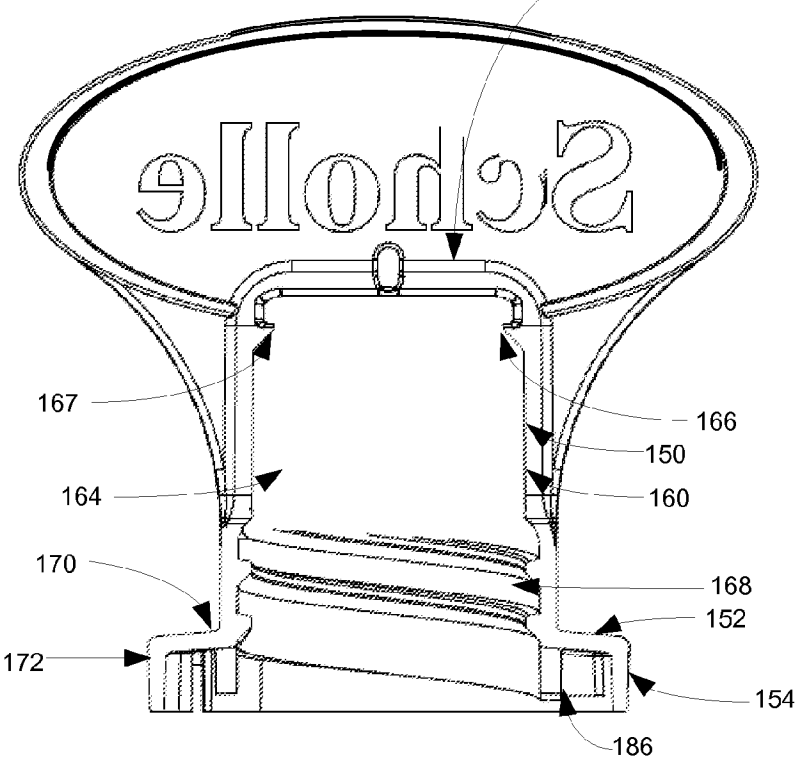
FIG. 15 of the drawings is a cross-sectional view of the cap of the pouch assembly of the present disclosure, taken generally about lines 15-15 of FIG. 14.

Spout 14 is shown in greater detail in FIGS. 6 through 8 as comprising attachment flange 30, outlet tube 32, filler grasping assembly 34 and cap affixing assembly 36. Typically, the spout comprises a molded member comprising a polymer such as a polyethylene or the like. The particular material from which the spout is formed is disclosed for exemplary purposes and is not deemed as being limiting. Generally, such a spout is often referred to as an fin seal spout. The spout in the configuration with the cap and the plug is shown in greater detail in FIGS. 2 through 5.

The attachment flange (often referred to as a sealboat) includes first side wall 40 and second side wall 42 opposite the first side wall. The two side walls are generally mirror images of each other and they cooperatively define central region 44 first side taper 46 and second side taper 48. The central region 44 corresponds to the outlet tube 32, and the tapers extend in either direction. In the configuration shown, the first and second side walls are generally parallel to each other and are centered about a plane that extends therebetween and that extends through the center of the outlet tube 32 so as to be substantially symmetrical. Each of the first and second sidewalls include a plurality of sealing ribs which are configured to engage with the seal 26 and the first and second side panels of the body so as to be sealingly engaged therewith.

The outlet tube 32 includes first end 50 and second end 52. The outlet tube extends through the attachment flange so as to provide access to the cavity 27 of the body of the pouch assembly. The outlet tube includes inner surface 54 and outer surface 56. The inner surface 54 defines a generally circular cross-sectional configuration. The inner surface includes a lower region, a central region and an upper region. The lower region has a diameter that is greater than the upper region, and the central region comprises a frustoconical connecting region spanning between the upper region and the lower region.

The outer surface includes first flattened side 57 and second flattened side 58. These opposing flattened sides are symmetrical with the attachment flange and are on opposing sides of the outlet tube. Such a configuration provides for drainage of liquid from cleaning station to drain and so that it is not trapped within the threads when the cap is ready for coupling. A plug sealing surface 51 is defined along the outer surface preferably spaced apart from the second end of the outer surface. The plug sealing surface and the upper end of the outlet tube have a thickness.

The filler grasping assembly 34 includes lower flange 60, upper flange 62, filler guide members 64 and overlap precluding member 66. The filler grasping assembly provides a structure by which the pouch assembly can be grasped, retained, supported, guided and/or moved within various sorting, filling, cleaning and/or capping equipment. The lower flange 60 includes major dimension sides 70*a*, 70*b*, minor dimension sides 72*a*, 72*b*, top surface 74 and bottom surface 76. The major dimension sides 70*a*, 70*b* generally are symmetrical about the outlet tube and the attachment flange 30, and are generally mirror images of each other taken about an plane that coincides with the plane defined with respect to the symmetry of the attachment flange first and second side walls 40, 42, while variations are contemplated. The minor dimension sides join the major dimension sides. The lower flange is substantially planar with the top and bottom surfaces 74, 76 being substantially parallel to each other, and substantially perpendicular to the outlet tube.

In the configuration shown, the major dimension sides 70*a*, 70*b* comprises outward convex curved members, in the configuration shown, a continuously curved outwardly convex configuration. In such a configuration, two adjacent contacting pouches will contact each other by way of the major dimension sides of the lower flange (and/or the upper flange, as will be disclosed below), wherein generally a single point of contact is maintained therebetween each along the major dimension sides. The single point of contact can move along the major dimension sides depending on the angular relationship between the adjacent pouches, however, it will be understood that the contact is limited to a generally small portion of the respective sides. In the particular configuration shown, the major dimension sides comprise an arcuate configuration that has a radius.

The upper flange 62 includes major dimension sides 78*a*, 78*b*, minor dimension sides 80*a*, 80*b*, top surface 82 and bottom surface 84. The upper flange, in the configuration shown is substantially identical in outward dimension to the lower flange 60. The two flanges are spaced apart from each other a predetermined distance, and are generally parallel to each other. As such, the major dimension sides 78*a*, 78*b* generally are symmetrical about the outlet tube and the attachment flange 30, and are generally mirror images of each other taken about an plane that coincides with the plane defined with respect to the symmetry of the attachment flange first and second side walls 40, 42, while variations are contemplated. The minor dimension sides join the major dimension sides. The lower flange is substantially planar with the top and bottom surfaces 82, 84 being substantially parallel to each other, and substantially perpendicular to the outlet tube. As the lower and the upper flange are substantially identical, as either or both of the upper and lower flanges are positioned proximate other pouches, the two contact adjacent upper and lower flanges at a single point of contact along the major dimension sides. Thus, the contact is limited between the spouts of adjacent pouches. Additionally, as one pouch is moved with respect to an adjacent pouch, either rotationally or laterally, the point of contact moves along the major dimension sides of both of the upper and lower flanges (where they are of different dimensions, the point of contact may be with only one of the upper and lower flanges, or may alternate between the upper and lower flange).

The filler guide members 64 are shown as comprising first side inner guide 86 and second side inner guide 88. The guides each extend from the top surface 74 of the lower flange 60 to the bottom surface 84 of the upper flange 62. The guides, in the configuration shown, are perpendicular to each of the upper and lower flanges, and are positioned on either side of the outlet tube 32. In the configuration shown, they are likewise perpendicular to the flattened sides 57, 58 of the outer surface of the outlet tube 32. In many instances, such as, for example within a filler or the like, guides engage and retain the pouch by extending into the area defined by the top surface of the lower flange, the bottom surface of the upper flange and the filler guide members. This space defines a dimensionally stable structure by which the pouch assembly can be grasped and retained. Moreover the filler guides assist with the position of the major dimension sides in the proper orientation within filling equipment and the like so as to provide the proper relationship with adjacent spout assemblies.

An overlap precluding member 66*a*, 66*b* is provided on either side of the outlet tube as extending from the top surface 82 of the upper flange 62. The overlap precluding member extends substantially perpendicular to the top surface 82 and buttresses from the outer surface of the upper flange generally proximate the center of the major dimension sides. The overlap precluding member precludes the shingling or overlapping positioning of adjacent pouch assemblies. That is, the overlap precluding member stops an upper flange of one pouch to go over the top surface of an adjacent upper flange.

The cap affixing assembly 36 comprises threads 90 and tamper evident strip locking coupling 92. The threads include first side thread 96 and second side threads 98. The first side thread 96 and the second side thread 98 are separated by the flattened sides 57, 58 and would otherwise be substantially continuous. In the configuration shown, the threads comprise double wound threads, however it is contemplated that single wound threads, or other types of threads are likewise contemplated.

The tamper evident strip couplings 92 includes first side tamper evident strip coupling 93 and second side tamper evident strip coupling 94. The two couplings engage a portion of a tamper evident strip or the like wherein the tamper evident strip is captured by the coupling when the cap is threaded onto the spout. Once captured, the strength of the capture exceeds the strength of the frangible portion of the tamper evident strip and, in turn, the when a user removes the cap, the frangible portion is broken, the cap is removed, and the tamper evident strip remains with the spout, again, captured by the tamper evident strip couplings.

Plug 16 is shown in FIGS. 9 through 12 as comprising top wall 102, inner axial skirt 104, outer axial skirt 106 and annular channel 108. The top wall 102 is shown as comprising outer surface 110, inner surface 112 and outer rim 119. The topography of the outer surface 110 includes inner concave surface 118 surrounded by an outer ring surface 116 and the outer rim 119. The outer rim 119 is substantially rounded and terminates in a substantially vertical surface proximate the upper wall 144 of the annular channel 108 (it is contemplated that it may likewise be inclined, chamfered, or otherwise). The outer rim 119 defines a diameter of the top wall. The top wall is substantially circular in configuration. The plug is shown in the environment of the spout and cap in FIGS. 2 through 5.

The inner axial skirt 104 includes inner surface 120, outer surface 122, upper end 124, lower end 126 and spacing ribs 128. The inner axial skirt 104 generally comprises a cylindrical member that has the same center as the top wall. The upper end 124 generally extends from the top wall in a dependent fashion that is generally perpendicular to the top surface (and in particular, the outer ring surface). The lower end 126 includes chamfered inner and outer surfaces so as to facilitate coupling to both equipment in the filler, and also coupling to the spout. The inner surface 120 generally defines a substantially uniform cylindrical central cavity which corresponds in size to a structure in a filler for receiving the plug upon removal from the spout. Such a structure is disclosed in co-pending application entitled "Rotary Filling Device For Aseptic Filling Of Pouches", the entire specification of which is hereby incorporated by reference in its entirety.

A plurality of spacing ribs 128 are positioned so as to extend axially outwardly from the outer surface of the inner axial skirt in a spaced apart configuration. In the configuration shown, the spacing ribs extend from the upper end 142 of the channel 107 along the outer surface to a position that is short of the hermetic seal bead 138 of the outer axial skirt. The ribs have a generally square or rectangular cross-sectional configuration. The ribs further have a chamfered or inclined surface proximate a bottom end thereof to facilitate the guiding of the spout therebeyond. A total of eight ribs are shown as being spaced apart generally symmetrically. As will be explained, the ribs provide a direct passageway from the cavity 27 of the pouch to the channel 107, terminating at the hermetic seal bead 138.

The outer axial skirt 106 includes inner surface 130, outer surface 132, upper end 134, lower end 136 and hermetic seal bead 138. The outer axial skirt is spaced apart axially from the inner axial skirt to define channel 107 therebetween. The spacing therebetween also defines upper end 142 of the channel between the inner surface 130 of the outer axial skirt and the outer surface 122 of the inner axial skirt. The outer annular skirt and the inner annular skirt are substantially coaxial, such that the channel is substantially uniform in configuration, and such that the two skirts are uniformly spaced apart, and with the ribs being substantially uniform in configuration. The outer axial skirt extends, in the configuration shown, beyond the outer rim 119 of the top wall, thereby defining the outermost diameter of the plug. In the configuration shown, the outer annular skirt stops short of the inner annular skirt so that the hermetic seal overlies the inner axial skirt spaced apart from the lower end thereof.

The annular channel 108 is shown as comprising upper wall 144, lower wall 146 and inner wall 148. The upper wall terminates at the outer rim 119 and generally forms a corner (which may be a sharp 90° corner, or which may be less than 90°, or which may have a slight chamfer). It will be understood that it is preferred that the upper wall of the annular channel does not have the rounded configuration of the outer rim 119. The annular channel is substantially uniform and defines a plane that is generally parallel to the outer ring surface 116 and generally perpendicular to the inner and outer axial skirts. The upper and lower walls of the annular channel, are preferably substantially parallel to each other, with the inner wall being substantially perpendicular to both. As will be explained below, the annular channel is configured for the receipt of equipment to remove the plug from the spout, and also configured to receive a portion of the cap for coupling thereto in a substantially locked engagement.

The cap 18 is shown in FIGS. 13 through 16 as comprising central body 150, lower axial flange 152, lower depending skirt 154 and tamper evident assembly 156. The central body 150 includes outer surface 160 and top panel 162 wherein the outer surface generally depends from the top panel. The top panel and the outer surface cooperate to define central bore 164. The central bore and/or the top panel in cooperation therewith defines plug coupling structure 166 which comprises, in the embodiment shown, transverse ledge 167 and corresponding openings 169*a*, 169*b*. As will be explained, the transverse ledge 167 extends into the annular channel 108 of the plug 16 to lock the structures together at least axially (while relative rotation may be permitted). Additionally, threads that engage with the first and second side threads 96, 98. The tightening of the cap directs the cap toward the upper flange 62 of the spout along the threads. Generally, the central body has a shape mating configuration to the spout, and in particular, the outlet tube of the spout. As such, the shape is slightly conical or frustoconical. In the configuration shown, an ornamental portion extends from the central body outwardly. In the embodiment shown, the ornamental portion comprises a planar element that extends about the central body as a planar member of substantially uniform thickness that is embossed with logos on either side thereof. Such an ornamental feature can likewise assist with providing leverage to open the cap and also to preclude swallowing of the cap by infants and toddlers.

The central body generally terminates proximate or at the lower axial flange 152. The lower axial flange 152 includes inner end 170 and outer end 172. The inner end extends from the outer surface of the central body outwardly in a manner generally parallel to the top panel and in a substantially planar configuration. The lower depending skirt 154 depends away from the central body in a generally cylindrical configuration from the outer end 172 of the lower axial flange.

The tamper evident assembly 156 is configured to interface with the tamper evident strip couplings 92. In particular, the tamper evident assembly 156 includes two structures which are on opposing sides of each other so as to correspond to the first side tamper evident strip coupling and the second side tamper evident strip coupling. As such, one of the tamper evident assembly will be described with the understanding that the other one is a substantial mirror image thereof.

In particular, the tamper evident assembly 156 includes flexible wing 180, frangible connection 182, window opening 184 and stop 186. The flexible wing 180 extends from the lower depending skirt inwardly and axially from proximal end 186 to distal end 188. At the distal end, the flexible wing is positioned inward of the lower depending skirt. The frangible connection 182 extends from the distal end 188 of the flexible wing to the lower depending skirt. The stop comprises an axial wall that extends across the axial flange from the lower depending skirt toward the central body and an annular wall that extends from the lower axial flange between the central body and the lower depending skirt.

With reference to FIGS. 13 through 16 and also FIG. 5, as the cap is initially tightened, the tamper evident strip couplings are positioned within the cavity 189 created by the lower axial flange 152 and the lower depending skirt 154, and, subsequently directed toward the proximal end 186 of the flexible wing. Further rotation directs the tamper evident strip couplings to direct the flexible wing outwardly toward the lower depending skirt until the tamper evident strip coupling is beyond the distal end of the flexible wing, at which time the flexible wing returns to the original configuration. It will further be understood that when the cap is rotated in the opposite direction, due to the inward position of the distal end 188 of the flexible wing, the tamper evident strip coupling is directed inwardly, and eventually, the frangible connection 182 is broken by the continued movement of the cap relative to the tamper evident strip coupling. It will be understood that the cap cannot be further rotated and removed until the frangible connection is broken, thus, evidencing that the cap has been removed or at least attempted to be removed.

The cooperative structure of the spout, plug and cap is shown in FIGS. 2 through 5. It will be understood that, advantageously, the pouch is provided in a fill configuration and in a complete configuration. In the fill configuration, the pouch has the plug installed. The plug has a hermetic seal between the seal bead 138 and the plug locking surface 51. As such, the spout can be sterilized through gamma radiation or the like with the plug precluding ingress into the cavity of the pouch. In addition, the plug can be easily removed and replaced within the filler to fill the pouch (i.e., within an aseptic environment). Once filled, the pouch can be removed from the aseptic filler and any number of different cap configurations can be coupled to the spout and to the plug. Such a cap is releasably coupled to the spout, and substantially fixedly coupled to the plug. As such, once mounted to the spout and the plug, the cap and the plug are removed in unison from the spout, and replaced in unison.

As such, the pouch assembly will first be described in the configuration provided for irradiation and filling. In such a configuration, the pouch assembly is provided with the spout and the plug coupled thereto. In such a configuration, the inner axial skirt 104 is positioned within the outlet tube 32 of the spout. The spacing ribs 128 contact the inner surface 54 of the outlet tube and provide the spacing between the inner axial skirt 104 and the inner surface of the outlet tube.

In the configuration shown in the drawings, the second end 52 of the outlet tube 32 is terminates proximate the upper end 142 of the channel 107. Similarly, due to the configuration of the plug locking surface 51 of the outer surface of the outlet tube, the hermetic seal bead 138 of the outer axial skirt hermetically seals with the plug locking surface, while the outer surface of the inner annular skirt remains spaced apart from the outlet tube. As a result, the seal is effectuated on the outer surface of the outlet tube by the hermetic seal and not by the inner axial skirt.

The plug can be removed by extending a removing member (i.e., a gripping arm, gripping wrench, gripping flange or the like) into the annular channel and grasping the same. Once grasped, the plug can be moved relative to the spout to overcome the hermetic seal so as to decouple the plug from the spout.

To replace the plug on the spout, the user can position the plug into a position wherein the plug overlies the spout. Once positioned, the user can direct the plug over the spout, thereby directing the inner axial skirt 104 into the outlet tube, with the outer axial skirt extending therearound. The hermetic seal bead engages the plug locking surface as the spacing ribs engage the inner surface of the outlet tube.

To install the cap, the user directs the cap 18 over the spout 14, which places the threads 90 of the spout in threaded engagement with the threads 168 of the cap. Continued engaging rotation eventually directs the top wall 102 of the plug 16 into contact with the transverse ledge 167. With the inclined configuration of the ledge and the rounded outer rim, continued rotation of the cap eventually directs the outer rim of the top wall beyond the ledge into a seated position, thereby axially locking the two structures together.

At the same time, the tamper evident assembly 156 engages the tamper evident strip couplings of the spout 14 and is eventually situated in the fully locked and assembled configuration. In addition, the user can see the cap engagement through the openings 169*a*, 169*b* in the cap proximate the ledge 167.

When a user desires to remove the cap and to have access to the cavity, the user first rotates the cap in the opposite direction from the assembly direction. As the user rotates the cap, the tamper evident strip couplings tear the frangible connection 182 of the tamper evident assembly 156 of the cap, evidencing that the cap has been rotated toward the open configuration. At the same time, the rotation of the cap axially directs the cap upward away from the spout. As the top wall is captured by the transverse ledge due to the configuration of the transfer ledge that extends into the annular channel, and due to the configuration of the upper wall of the annular channel, the plug is axially locked to the cap. Thus further removal of the cap along the threads pulls the plug until the hermetic seal bead 138 slides up the spout and beyond the second end of the outlet tube. And, at the same time, the threads reach the end of threaded engagement, and the cap/plug combination can be removed from the spout with the user having access to the cavity.

Advantageously, the opposing flattened sides provide for drainage of cleaning fluids and the like prior to application of the cap. Additionally, if the user desires to recap the pouch, the plug is recoupled to the spout to provide an effective seal. In certain configurations, the ornamental portion of the cap can serve to provide additional leverage to remove the cap and plug (especially where the additional force is required either due to the tamper evident features or due to the engagement of the hermetic seal and the outlet tube).

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A plug for a pouch assembly, the plug attachable to a spout of a pouch, the spout providing access to a cavity defined by the pouch, the plug comprising:

a top wall, the top wall including an outer surface and an outer rim;

an inner axial skirt depending from the top wall in a direction opposite the top wall, the inner axial skirt including an inner surface, an outer surface, an upper end and a lower end, the inner surface defining an inner cavity; and an outer axial skirt axially spaced apart from the inner axial skirt, the outer axial skirt including an inner surface and an outer surface, an upper end proximate the top wall and a lower end spaced apart therefrom, a seal bead positioned on the inner surface of the outer axial skirt spaced apart from the upper end, the seal bead extending inwardly toward the inner axial skirt;

wherein the plug is attachable to the spout of the pouch, wherein the seal bead is structurally configured to hermetically seal against the spout, while the inner axial skirt extends into the spout, while precluding sealed engagement of the inner axial skirt with the spout of the pouch.

2. The plug of claim 1 wherein the inner surface of the inner axial skirt defines a cavity structurally configured to receive a post or other component of a filler.

3. The plug of claim 1 wherein the inner axial skirt and the outer axial skirt are substantially concentric cylindrical members.

4. The plug of claim 1 wherein the inner axial skirt further includes a plurality of spacing ribs extending outward from the outer surface of the inner axial skirt, the plurality of spacing ribs structurally configured to extend to the spout of the pouch, to, in turn, provide passageways between the axial ribs, so as to maintain fluid communication between the seal bead and the cavity.

5. The plug of claim 4 wherein the plurality of spacing ribs comprises eight ribs substantially equally spaced about the outer surface of the inner axial skirt.

6. The plug of claim 1 further comprising an annular channel disposed below the top wall.

7. The plug of claim 6 wherein the annular channel includes an upper wall and a lower wall, the upper and lower walls being spaced apart from each other, with an inner wall spanning therebetween.

8. The plug of claim 7 wherein the annular channel defines a plane that is substantially perpendicular to the inner axial skirt and the outer axial skirt.

9. The plug of claim 7 wherein the annular channel is disposed between the top surface and the channel defined by the inner and outer axial skirts.

10. The plug of claim 9 wherein the outer rim of the top wall is one of chamfered, inclined and rounded toward, and meets the upper wall of the annular channel.

11. The plug of claim 10 wherein the top surface includes a concave surface portion inwardly spaced from the outer rim.

12. The plug of claim 11 wherein the top surface further includes a substantially planar outer ring surface between the outer rim and the concave surface portion.

13. The plug of claim 12 wherein the inner axial skirt extends beyond the hermetic seal bead positioned on the inner surface of the outer axial skirt.

14. A pouch assembly comprising:

a pouch defining a cavity;

a spout having:

an attachment flange sealingly engaged to a pouch body, providing access to a cavity defined thereby;

an outlet tube having a first end cooperating with the cavity, and a second end spaced apart therefrom, and an outer surface, with a plug locking surface defined in the outer surface; and a thread extending about the outer surface of the outlet tube;

a plug having:

a top wall having an outer rim;

an inner axial skirt depending from the top wall in a direction opposite the top wall, the inner axial skirt including an inner surface, an outer surface, an upper end and a lower end, the inner surface defining an inner cavity; and an outer axial skirt axially spaced apart from the inner axial skirt, the outer axial skirt including an inner surface and an outer surface, an upper end proximate the top wall and a lower end spaced apart therefrom, a seal bead positioned on the inner surface of the outer axial skirt spaced apart from the upper end, the seal bead extending inwardly toward the inner axial skirt;

wherein the inner axial skirt is releasably extendable into the outlet tube with the hermetic seal bead forming a hermetic seal against the plug locking surface of the outlet tube, a portion of the inner axial skirt being spaced apart from the outlet tube.

15. The pouch assembly of claim 14 wherein the inner axial skirt further includes at least one rib extending outwardly from the outer surface of the inner axial skirt, the at least one rib maintaining separation of the outer surface of the inner axial skirt and the inner surface of the outlet tube of the spout.

16. The pouch assembly of claim 14 wherein the plug further includes an annular channel disposed below the top wall, the annular channel including an upper wall that meets the outer rim of the top wall.

17. The pouch assembly of claim 16 wherein the annular channel defines a plane that is substantially perpendicular to each of the inner axial skirt and the outer axial skirt.

18. The pouch assembly of claim 17 wherein the annular channel further includes a lower wall that is substantially parallel to the upper wall and spaced apart therefrom by an inner wall.

19. The pouch assembly of claim 18 wherein the inner skirt extends beyond the hermetic seal bead of the outer axial skirt.

20. The pouch assembly of claim 16 further comprising a cap, the cap including:

a central body configured to extend over the outlet tube of the spout, the central body having a transverse ledge;

wherein the transverse ledge extends into the annular channel of the plug, to, in turn, axially couple the plug to the cap, whereupon removal of the cap from the pouch removes the plug together with the cap.

21. The pouch assembly of claim 20 wherein the central body of the cap includes a plurality of threads that, upon engagement of the cap and the spout, threadedly engage the threads of the spout.

* * * * *